US005680082A

United States Patent [19]

Stocklin

[11] Patent Number: 5,680,082

[45] Date of Patent: Oct. 21, 1997

[54] MINIATURE MULTICONTACT ELECTROMAGNETIC RELAY FOR INDUSTRIAL USE

[75] Inventor: Felix Stocklin, Baar, Switzerland

[73] Assignee: Carlo Gavazzi AG, Steinhausen, Switzerland

[21] Appl. No.: 508,070

[22] Filed: Jul. 27, 1995

[30] Foreign Application Priority Data

Jul. 29, 1994 [IT] Italy ..... MI940570 U

[51] Int. Cl.[6] ..... H01H 67/02

[52] U.S. Cl. ..... 335/128; 200/174; 218/24

[58] Field of Search ..... 200/17 R; 218/24; 335/78–89, 106, 107, 119–121, 124–128, 131–133, 159, 185–204

[56] References Cited

U.S. PATENT DOCUMENTS

| | | | |
|---|---|---|---|
| 3,684,986 | 8/1972 | Nagamoto et al. | 335/200 |
| 3,733,568 | 5/1973 | Prouty et al. | 335/186 |
| 4,758,809 | 7/1988 | Bell | 335/128 |
| 4,825,179 | 4/1989 | Nagamoto et al. | 335/80 |
| 4,890,080 | 12/1989 | Hashimoto | 335/17 |
| 5,017,898 | 5/1991 | Kuzukawa | 335/128 |

*Primary Examiner*—Michael L. Gellner
*Assistant Examiner*—Michael A. Friedhofer
*Attorney, Agent, or Firm*—Herbert Dubno

[57] ABSTRACT

An industrial type relay in which the armature acts upon a movable contact arrangement for shifting the same between fixed normally closed contacts on the relay head and the normally open contacts thereof. The head carries respective feed terminals which have elastic ends pressing on the movable contacts between their support and their contact ends so as to provide a preset force defining the contact pressure of the movable contacts against the normally closed fixed contacts.

11 Claims, 4 Drawing Sheets

MINIATURE MULTICONTACT ELECTROMAGNETIC RELAY FOR INDUSTRIAL USE

FIELD OF THE INVENTION

The present invention relates to a miniature multicontact electromagnetic relay for industrial use.

BACKGROUND OF THE INVENTION

A conventional multicontact electromagnetic relay comprises an electromagnetic circuit and a contact system associated with the leads of a base defining the head of the relay.

The contact system comprises movable contacts which are switched from normally closed fixed contacts to normally open fixed contacts, all being connected to the head terminals together with the feed leads of the coil.

In two or four contact multicontact electromagnetic relays for industrial use, the head terminals are of a type for insertion into a standard socket. The fixed contacts are associated with the corresponding head terminals while the movable contacts are associated with a movable armature which switches the contacts when the coil is excited. The movable contacts are electrically connected with their feed terminals fixed on the header by electrical leads having their ends welded to the feed terminals on the other side.

The electrical leads inside the conventional miniature relays for industrial use, besides occupying considerable space, require a welding operation to the movable contacts and to the fixed feed contacts at a considerable of production cost.

Furthermore, the electrical leads, even though flexible, influence the correct motion of the armature and therefore the switching of the movable contacts.

The space occupied by the electrical leads (one for each fixed feed contact) entails a reduction of the coil size for certain size of the conventional relay and therefore a reduction of the sensitivity of the electromagnetic relay.

OBJECTS OF THE INVENTION

An object of the present invention is to eliminate the ahoy& mentioned drawbacks by providing a multicontact electromagnetic relay for industrial use having a head interchangeable with that of conventional relays and which is composed of a reduced number of components with respect of the comparable conventional relays.

An important object of the invention is to provide a multicontact electromagnetic relay for industrial use having no electrical leads inside it for connecting the movable contacts with the relay feed terminals and, therefore, a relay which is capable of assembly.

A further object of the invention is to provide a multicontact electromagnetic relay for industrial use which has no electrical leads inside it and therefore allows the use of a larger coil with respect to conventional relays of the same size.

Still a further object of the invention is to provide a multicontact electromagnetic relay for industrial use of lower cost, thanks to the simplified structure and assembly, and of greater power and sensitivity compared to conventional relays of the same size.

SUMMARY OF THE INVENTION

These and other objects that will be more apparent hereinafter, are achieved with a multicontact electromagnetic relay for industrial use comprising an electromagnetic circuit defined by a coil, a U bolt, an armature movable on said U bolt in contrast and by the action of elastic means, and movable contacts actuated by said armature for switching from normally closed fixed contacts to normally open fixed contacts defining the head of said relay together with feed terminals of said movable contacts and the feed terminals of said coil. Each of the feed terminals of said movable contacts comprises elastic means for electrically feed said movable contacts and for applying a preset force on said movable contacts adapted to define an optimal contact pressure with said normally closed fixed contacts.

BRIEF DESCRIPTION OF THE DRAWING

Further characteristics and advantages of the invention will be more apparent from the following description of a multicontact electromagnetic relay for industrial use, according to the invention, illustrated, by way of example in the enclosed drawing in which.

SPECIFIC DESCRIPTION

Figure 1:
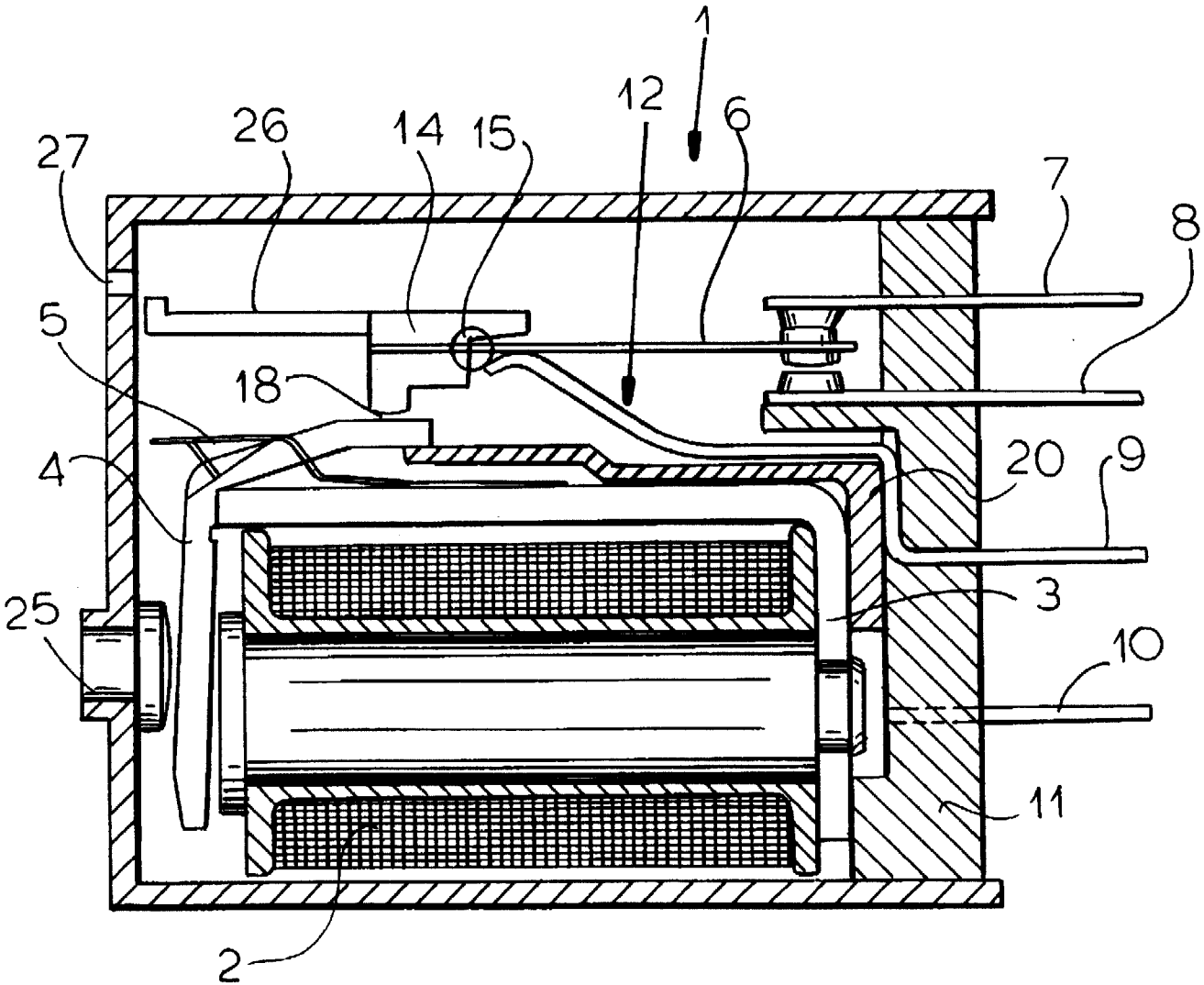
FIG. 1 is a lateral cross sectional view of the multicontact electromagnetic relay, according to the invention having a head interchangeable with the head of a conventional relay.
Figure 2:
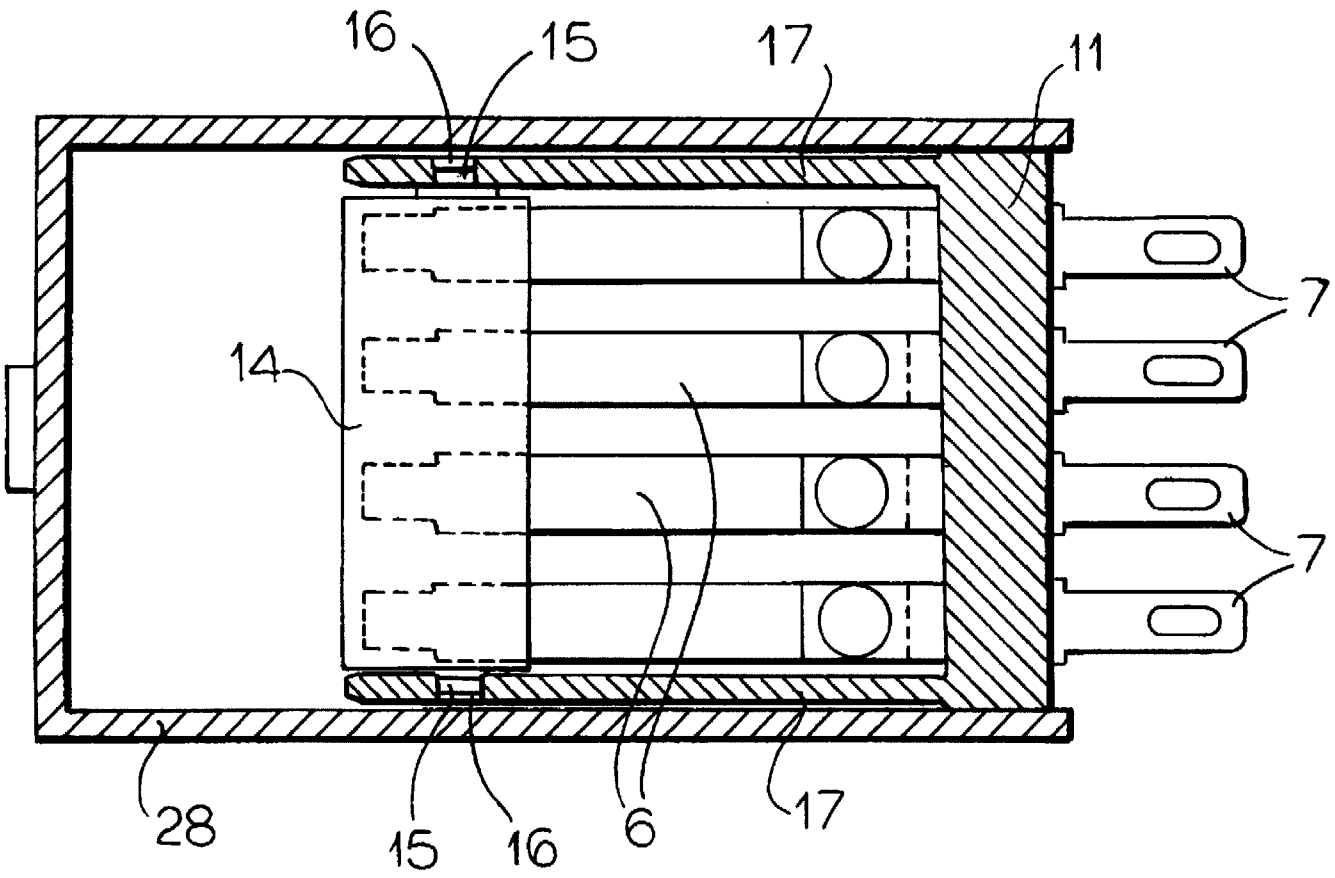
FIG. 2 is a cross sectional view taken perpendicular to the section plane of FIG. 1 of the multicontact electromagnetic relay.

The multicontact electromagnetic relay for industrial use, according to the invention, designated by the reference numeral 1, comprises an electromagnetic circuit defined by a coil 2, a U bolt 3, and an armature 4 movable on the bolt 3 against the action of elastic means, for example, a spring 5 having an end fixed to the bolt 3.

The electromagnetic circuit further comprises a contact system, defined by movable contacts 6 which are actuated by the armature 4 for switching them from engagement with normally closed fixed contacts 7 into engagement with normally open fixed contacts 8; feed terminals 9 for feeding the movable contacts; and coil feed terminals 10.

The assembly of the normally closed and normally open fixed contacts 7 and 8, of the feed terminals 9 of the movable contacts and of the coil feed terminals 10 defines the head 11 of the relay.

Advantageously, each of the movable contact feed terminals 9 is provided with elastic means 12, for electrically feeding the movable contacts 6 and for applying a preset force adapted to define an optimal contact pressure between the movable contacts 6 and the normally closed fixed contacts 7.

The elastic means 12 is defined by an elastically yielding portion 13 of the feed terminals 9.

In this manner, two advantages are achieved.

Firstly, with only one element, defined by the feed terminals 9, the movable contacts 6 are electrically fed and there is an elastic preset force adapted to maintain the movable contacts against the normally closed fixed contacts 7 with an optimal contact pressure, Secondly, the elastic forces acting on the movable contacts 6 and those acting on the armature 4 are separated thereby ensuring a regular and optimal operation of the relay independently from external agents such as shocks, vibrations and similar.

Conveniently, the mobile contacts 6 are also connected with a support member 14, for example provided by co-injection molding in thermoplastic insulating material, or by two plates in thermoplastic material welded together, by ultrasonic welding or any other suitable system. The support member 14 has hinge means for its controlled rotation about an axis perpendicular to the coil 2.

More particularly, the hinge means is defined by two pivots 15 arranged coaxially and spaced apart and adapted to engage in respective seats 16 provided on the two opposed walls 17 of the header 11.

The two walls 17 also act as guides for the introduction of a cover above the header 11, thereby making the connection of the two elements easier.

In case the contact system is that illustrated in FIG. 1, the support member 14 has a domed control portion 18, facing the armature 4, for moving the support member about the rotation axis defined by the pivots 15.

Figure 3:
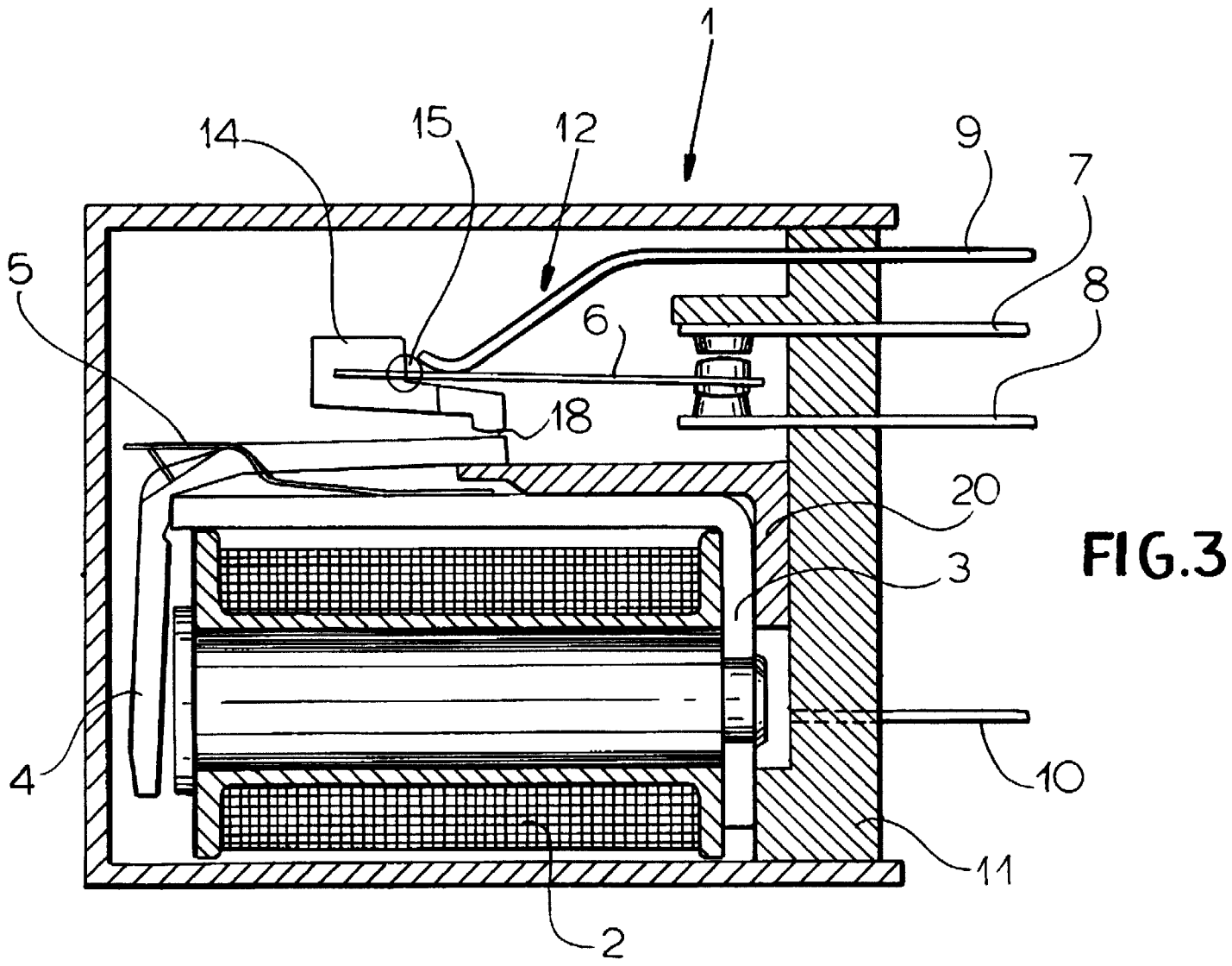
FIG. 3 is a view similar to FIG. 1 of a further embodiment of the multicontact electromagnetic relay shown in FIG. 1 with a different head which is not interchangeable with the head of a conventional relay.
Figure 4:
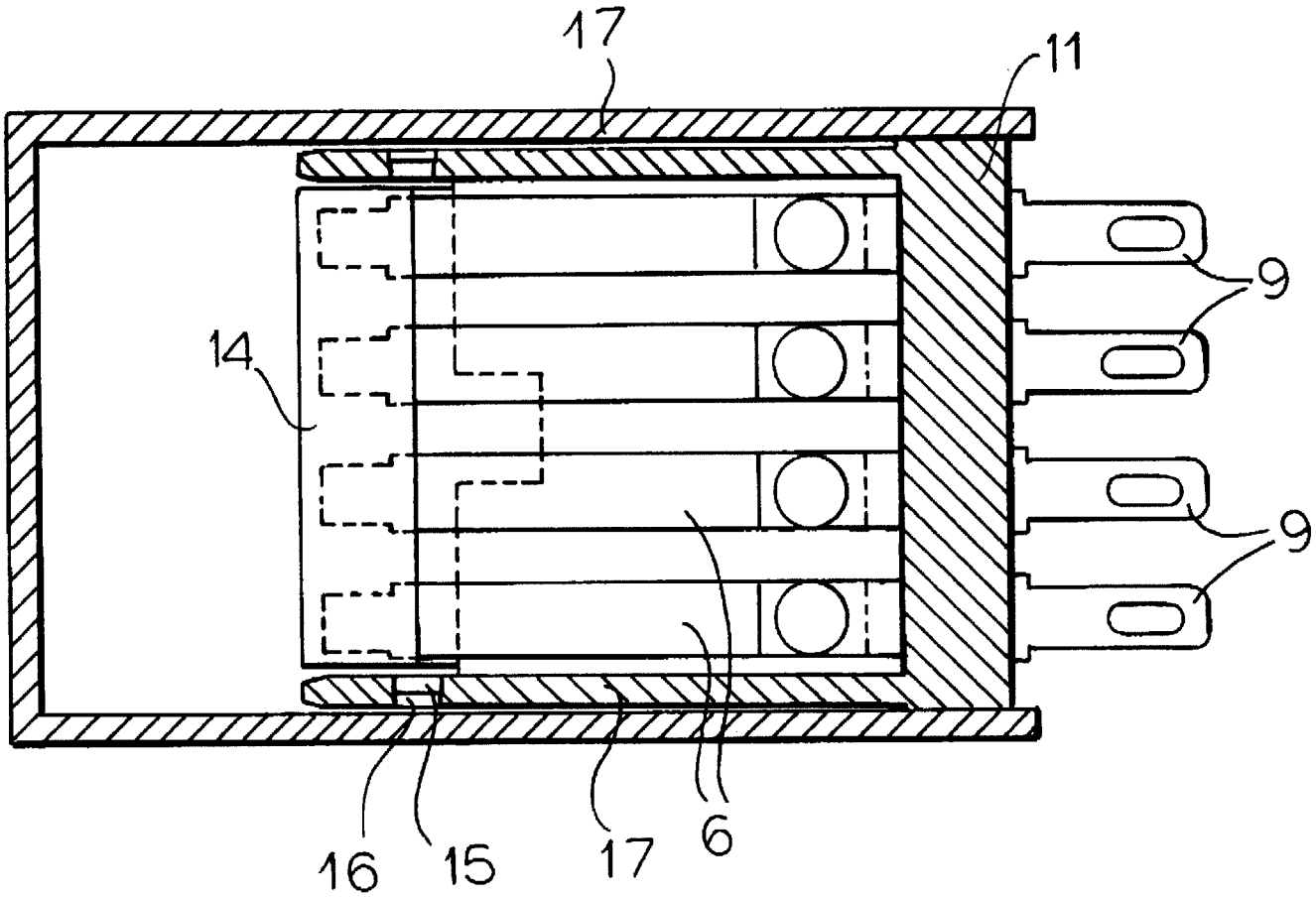
FIG. 4 is a view similar to FIG. 2 of the multicontact electromagnetic relay shown in FIG. 3, according to, the invention.

If the contact system is that illustrated in FIG. 3, domed portion 18 is arranged between the support member and the head 11, with respect to the rotation axis of the support member 14.

In both the above described embodiments, the elastic portions 13 of feed terminals 9 engage the movable contacts 6 in a region comprised between the hinge axis of the support member and the normally closed and normally open fixed contact 7 and 8. Between the coil 2 and the contacts of the header 11, an insulating case 20 is provided and conveniently defines a support for the armature 4 when the coil is not excited.

The structure of the miniature multicontact electromagnetic relay for industrial use allows arranging inside it a manual switch member for shifting of the movable contacts from the normally closed fixed contacts to the normally open fixed contacts 7 and 8, such manual switch member acting directly on the armature 4.

In particular, the coil is arranged inside the relay with its axis substantially perpendicular to the head 11, the manual switching operation is possible by simply depressing a button 25 adapted to displace the armature.

The same relay structure also to visibly signals the excitation of the relay without further elements as in conventional relays, by simply providing the support member 14 with a portion 26 extending to the opposite side of the header 11 to a window 27 provided on the cover 28.

The excitation of the relay will position the colored end of the portion 26 at said window 27 making it visible.

It is also noted that the above described arrangement of the coil 2 allows an increase in its longitudinal and radial dimension giving the relay more power and sensitivity with respect of conventional relays of the same external size.

The operation of the miniature multicontact electromagnetic relay for industrial use, according to the invention, is apparent from what has been described and illustrated.

In particular, when the relay is in the rest position (unexcited core), the movable contacts 6 are pressed against the normally closed fixed contacts 7 by the elastic portions 13 of the feed terminals 9 which provide the passage of current and the optimal contact pressure on the normally closed fixed contacts. In the working position (excited relay), the armature 4 of the electromagnetic, circuit acts on the support member 14 of the movable contacts 6, making the support member rotate about its rotation axis and overcoming the reaction of the elastic portions 13 of the feed terminals 9.

In this manner, the movable contacts switch from the normally closed fixed contacts to the normally open fixed contacts with the selected pressure on the normally open fixed contacts.

It has been seen in practice that the miniature multicontact electromagnetic relay for industrial use, according to the invention, is also particularly convenient because it is constituted by an extremely reduced number of elements, because the elastic forces acting on the movable contacts are distinct and independent from those acting on the armature, and because the excitation of the relay can be optically signalled without further elements.

The materials employed, as well as the dimensions, may any according to the specific needs and the state of the art.

I claim:

1. A multicontact electromagnetic relay for industrial use, comprising:

an electromagnetic circuit comprising:

a U-shaped magnetic member, a coil on a leg of said U-shaped magnetic member, an armature movable on said U-shaped magnetic member and juxtaposed with said leg for displacement upon excitation of said coil, said armature being formed with movable contacts, and elastic means acting upon said armature against said displacement; and a head formed with normally closed fixed contacts engageable by said movable contacts, normally open fixed contacts engageable by said movable contacts upon displacement of said armature on excitation of said coil, respective terminals connected to said coil and to said fixed contacts, and respective feed terminals connected to said movable contacts and provided with further elastic means bearing on said movable contacts for electrical connection thereto and applying to said movable contacts a preset force defining a contact pressure of said movable contacts against said normally closed fixed contacts.

2. The multicontact electromagnetic relay defined in claim 1 wherein said further .elastic means is formed by an elastically yieldable end of said feed terminals engaging said movable contacts.

3. The multicontact electromagnetic relay defined in claim 1 further comprising a support member carrying said movable contacts and provided with a hinge for rotation of said support member about an axis perpendicular to an axis of said coil.

4. The multicontact electromagnetic relay defined in claim 3 wherein said further elastic means is formed by an elastically yieldable end of said feed terminals engaging said movable contacts, said ends of said feed terminals engaging said movable contacts between said hinge and said normally closed fixed contacts.

5. The multicontact electromagnetic relay defined in claim 1 further comprising an insulating case between said coil and said feed terminals, said case forming a support for said armature in an unexcited condition of said coil.

6. The multicontact electromagnetic relay defined in claim 1 further comprising a manual member actuatable to displace said armature and switch said movable contacts from engagement with said normally closed contacts into engagement with said normally open contacts.

7. The multicontact electromagnetic relay defined in claim 1 wherein said coil has an axis substantially perpendicular to said head.

8. A multicontact electromagnetic relay for industrial use, comprising:

an electromagnetic circuit comprising:

a U-shaped magnetic member, a coil on a leg of said U-shaped magnetic member, an armature movable on said U-shaped magnetic member and juxtaposed with said leg for displacement upon excitation of said coil, said armature being formed with movable contacts, and elastic means acting upon said armature against said displacement; and a head formed with normally closed fixed contacts engageable by said movable contacts, normally open fixed contacts engageable by said movable contacts upon displacement of said armature on excitation of said coil, respective terminals connected to said coil and to said fixed contacts, respective feed terminals connected to said movable contacts and provided with further elastic means bearing on said movable contacts for electrical connection thereto and applying to said movable contacts a preset force defining a contact pressure of said movable contacts against said normally closed fixed contacts, a pair of opposite walls, a support member carrying said movable contacts, and hinge means for controlled rotation of said support member about an axis perpendicular to an axis of said coil, said hinge means including two spaced apart coaxial pivots engaging respective seats on said opposite walls.

9. A multicontact electromagnetic relay for industrial use, comprising:

an electromagnetic circuit comprising:

a U-shaped magnetic member, a coil on a leg of said U-shaped magnetic member, an armature movable on said U-shaped magnetic member and juxtaposed with said leg for displacement upon excitation of said coil, said armature being formed with movable contacts, and elastic means acting upon said armature against said displacement; and a head formed with normally closed fixed contacts engageable by said movable contacts, normally open fixed contacts engageable by said movable contacts upon displacement of said armature on excitation of said coil, respective terminals connected to said coil and to said fixed contacts, respective feed terminals connected to said movable contacts and provided with further elastic means bearing on said movable contacts for electrical connection thereto and applying to said movable contacts a preset force defining a contact pressure of said movable contacts against said normally closed fixed contacts a pair of opposite walls, a support member carrying said movable contacts, and hinge means for controlled rotation of said support member about a support-member axis perpendicular to an axis of said coil, said support member having a control domed portion facing said armature for moving said support member about said support-member axis.

10. The multicontact electromagnetic relay defined in claim 9 wherein said domed portion being located on the same side as said head of said hinge means.

11. The multicontact electromagnetic relay defined in claim 9 wherein said dome portion is arranged on an opposite side of said hinge means from said head.

* * * * *